US005116298A

United States Patent [19]

Bondanelli et al.

[11] Patent Number: 5,116,298

[45] Date of Patent: May 26, 1992

[54] CONTROL PROCESS AND APPARATUS FOR THE PRODUCTION OF CIGARETTE FILTERS

[75] Inventors: Luigi Bondanelli, Zola Predosa; Mauro Sirani, Castenaso; Alfonso Schembri, Monteneglio; Dante Boido, Bologna, all of Italy

[73] Assignee: Intertaba, S.p.A., Zola Predosa, Italy

[21] Appl. No.: 553,117

[22] Filed: Jul. 13, 1990

[30] Foreign Application Priority Data

Jul. 20, 1989 [GB] United Kingdom ..... 8916589

[51] Int. Cl.[5] ..... B31C 13/00

[52] U.S. Cl. ..... 493/4; 493/37; 493/40; 73/38; 131/906

[58] Field of Search ..... 493/37, 39, 40–45, 493/47, 48, 49, 50, 4; 73/37, 38; 131/904, 906, 907, 908

[56] References Cited

U.S. PATENT DOCUMENTS

| | | | |
|---|---|---|---|
| T941,011 | 12/1975 | Morrison et al. | 493/4 |
| 3,380,351 | 4/1968 | Cox et al. | 493/4 |
| 3,971,695 | 7/1976 | Block | 493/4 X |
| 3,974,007 | 8/1976 | Greve | 493/4 X |
| 4,175,479 | 11/1979 | Roullier | 493/4 |
| 4,341,109 | 7/1982 | Evans, Jr. | 73/38 X |
| 4,355,535 | 10/1982 | Vaughan | 73/38 X |
| 4,363,235 | 12/1982 | Vulliens et al. | 73/38 |
| 4,567,752 | 2/1986 | Labbé | 73/38 X |
| 4,724,429 | 2/1988 | Millen et al. | 493/4 X |
| 4,865,051 | 9/1989 | Federle et al. | 131/904 X |

FOREIGN PATENT DOCUMENTS

| | | | |
|---|---|---|---|
| 2178293 | 2/1987 | United Kingdom | 131/908 |

OTHER PUBLICATIONS

Filtrona Instruments & Automation Ltd., "Quartet Systems for Filters" brochure, undated.

*Primary Examiner*—Bruce M. Kisliuk
*Assistant Examiner*—John A. Marlott
*Attorney, Agent, or Firm*—Jeffrey H. Ingerman

[57] ABSTRACT

To improve quality control a cigarette filter manufacturing line is provided with a testing station which periodically removes a filter to test the diameter and resistance to draw. The mean diameter and RTD of a number of filters is calculated and compared to acceptable ranges. Adjustments are made to the manufacturing line to correct any unacceptable values according to a set of priorities dependent on the degree and sense of the inaccuracies.

14 Claims, 4 Drawing Sheets

CONTROL PROCESS AND APPARATUS FOR THE PRODUCTION OF CIGARETTE FILTERS

FIELD OF THE INVENTION

This invention relates to the control of the manufacture of cigarette filters to optimise production quality.

BACKGROUND OF THE INVENTION

One known quality control system for cigarette filter manufacture is sold under the trade mark QUARTET by Filtrona Instruments and Automation Limited. This system provides an automated statistical analysis of current quality trends which enables a machine operator to take whatever corrective action is deemed necessary. The system operates by picking up filters from the production line, measuring a number of filter parameters for each filter, displaying the measured parameters and developing a statistical analysis of the filter parameters. The system has a disadvantage in that it leaves the corrective action necessary to the machine controller to determine and implement. This is both slow and prone to inaccuracies.

OBJECT OF THE INVENTION

The object of the present invention is to overcome the above mentioned disadvantages. It is a further object of the invention to provide a method and apparatus which provides feedback control of a filter testing station.

Another object of the invention is to provide a method and apparatus which tests two variable parameters of a filter which has been removed from a production line.

A still further object of the invention is to provide a method and apparatus which adjusts one or more parameters of a cigarette filter in accordance with the results of testing and in accordance with a predetermined hierarchy of priorities.

A further object of the invention is to provide a method and apparatus which compares one or more measured parameters to targets and which adjust one or more parameters in accordance with a predetermined set of priorities dependent upon which parameter is outside a target and the degree and sense of any excursions from a target.

A further object of the invention is to provide a method and apparatus of controlling manufacture of cigarette filters in which a range of acceptable values around a target value are defined for a number of variable parameters and adjustments to each parameter may be made in accordance with measured conditions and a predetermined set of priorities, the adjustments being made to correct the parameter to bring it to the limit of the parameter range.

It is still a further object of the invention to provide apparatus for measuring resistance to draw of a cigarette filter in which cigarette filters are removed from a reservoir drum and expelled from the RTD measuring apparatus at an angle orthogonal to filters on the drum.

It is a still further object of the invention to provide apparatus for removing cigarette filters from a drum reservoir.

A further object of the invention is to provide a system in which adjustments made to filter parameters depend on how far the parameter is from a target value and whether it is below or above that value.

SUMMARY OF THE INVENTION

The present invention provides for an apparatus and method for controlling the manufacture of cigarette filters.

The apparatus of the invention includes means which periodically remove for testing a filter from the production line. The filter is removed from a drum reservoir. Measuring means measure at least two variable parameters of the removed filters and the measurements are compared by a processor to predetermined targets. The processor includes means for determining necessary adjustments to the variables and controls the relevant machinery on the production line which controls that parameter. Adjustments are determined by the processor in accordance with a predetermined set of priorities dependent upon which parameter is outside its target and the degree and sense of each excursion from the target.

The system embodying the invention has the advantage of providing feedback control of the process. Furthermore, the adjustments made to the filter parameters depend on how far the parameter is from the target value and whether it is below or above the target value.

In a preferred embodiment of the invention the processor means instructs adjustment of each parameter to a value just within a range of values around the target value.

In another preferred embodiment of the invention the means for removing filters from the drum comprises a filter ejector means which ejects filters from the drum. A shuttle is provided which receives ejected filters individually. Guidance means guide the filter into the shuttle and rotation means rotate the shuttle between a first filter receiving position and a second filter dispensing position in which filters can be ejected by compressed air into a delivery tube. The filters in the second position are orthogonal to the filters on the drum.

The apparatus of the invention also provides a resistance to draw testing apparatus. The apparatus comprises a gauging head which has a gas inlet and outlet, and a filter receiving sleeve within the head. The sleeve has corresponding apertures so that gas can pass across a filter in the sleeve. A base portion of the head has a port for gas which assists in ejection of filters. The device is provided with a means for inversion to assist in a filter ejection.

The method of the present invention includes:

- periodically removing a completed filter from a production line on which said filters are manufactured;
- measuring at least two variable parameters of said removed filter;
- comparing each of said measured parameters with a respective predetermined target; and
- adjusting the operating conditions affecting one parameter in response to the comparison if one or both are outside their respective targets;
- wherein said adjustment is performed in accordance with a predetermined set of priorities dependent upon which parameter is outside said target and the degree and sense of each excursion from said target.

In a preferred embodiment of the method of the invention said target for each parameter comprises a range of acceptable values around a target value and said adjustment of the operating conditions causes one of the parameters to move into the acceptable range.

In a further preferred embodiment of the method of the invention the parameters are measured for a plurality of filters and the adjustments are made in accordance with the means values of the parameters.

BRIEF DESCRIPTION OF THE DRAWINGS

The above and other objects and advantages of the invention will be apparent from the following detailed description, taken in conjunction with the accompanying drawings, in which.

DETAILED DESCRIPTION OF THE INVENTION

Figure 1:
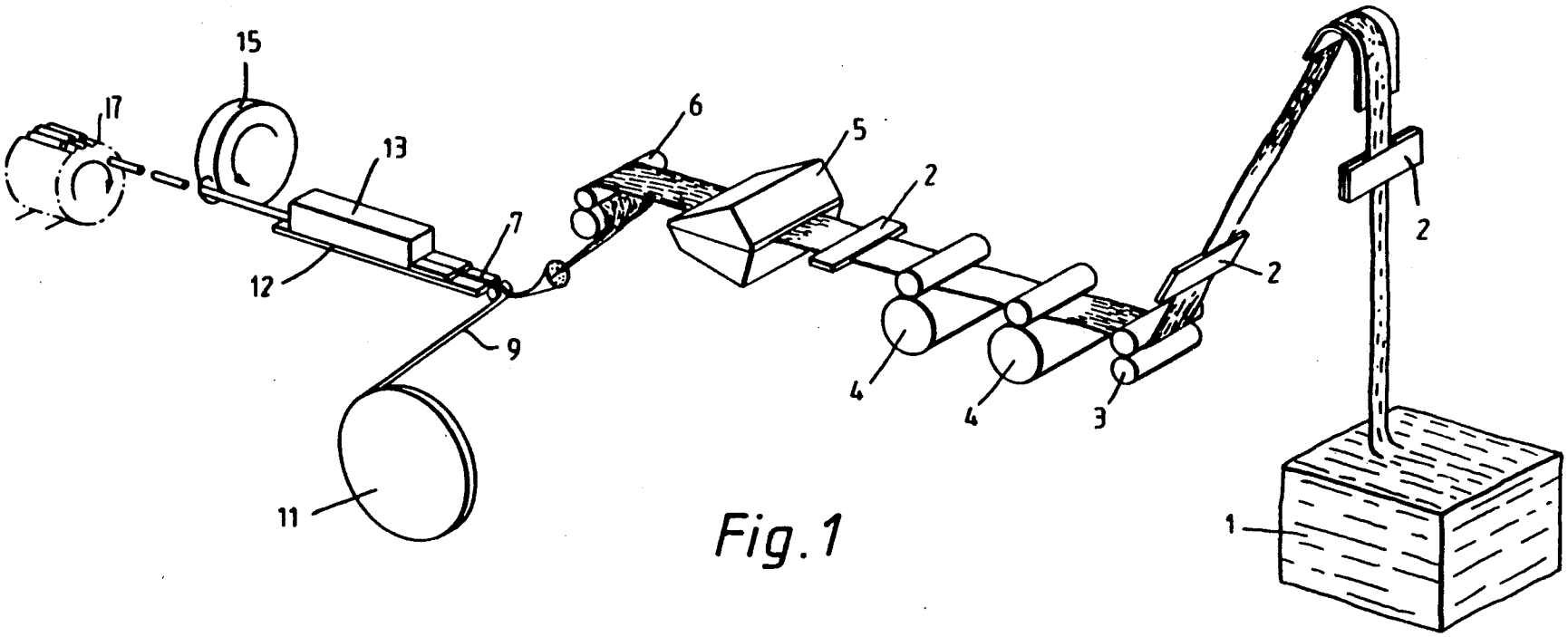
FIG. 1 is a sketch of the process for manufacture of cigarette filters.

Referring to FIG. 1, tow is drawn from a bale 1 through banding jets 2 and pre-tension rollers 3 by drawing rollers 4. The tow is then drawn through a plasticizer spray booth 5 and delivery rollers towards a garniture belt 7. A wrapper 9 is fed from a roll 11 onto the belt 7 and the tow is laid down on the paper. Part way along the belt the tow and paper are shaped by curved side walls 12 and pressure is applied (at 13) to produce a tubular filter having a wrapper around its outer surface. The length of filter is cut at 15 and the filter lengths are conveyed away to a reservoir.

Figure 2:
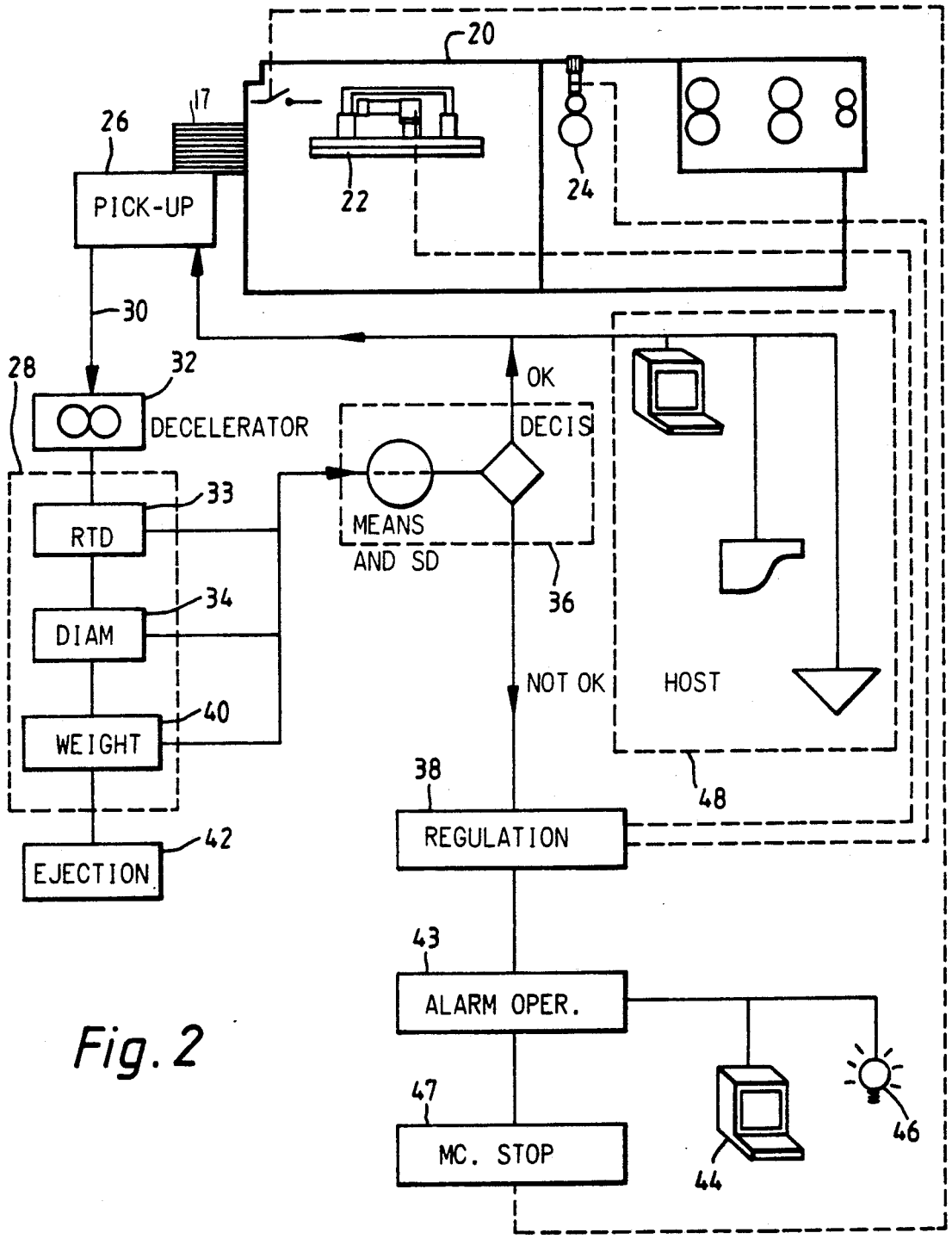
FIG. 2 is a block diagram of the control apparatus of the invention.

Referring now to FIG. 2, there are two parameters of the filter which are measured and controlled, the filter diameter D and the 'Resistance to draw' RTD. The latter parameter is a measure of resistance of the filter to air and is dependent on how tightly packed the filter tow is. Although other factors such as the amount of plasticizer used are important they do not need a continuous automatic control.

In FIG. 2 the filter production line is shown schematically at 20 and basically comprises a diameter control 22 and an RTD control 24. The diameter control comprises an automatically controlled servomotor which raises or lowers the upper garniture bar on the garniture belt and the RTD control comprises a motor control for increasing or decreasing the ratio between the speed of the tow delivery rollers and the speed of the garniture belt. The adjustments made to both the delivery roller speed and the upper garniture bar are proportional to the deviation of diameter or RTD from prescribed limits.

Filters to be tested are taken off the production line by pick-up unit 26 which will be described in greater detail in due course. A filter rod is sent pneumatically from the pick-up unit 26, arranged under fluted drum 17 at the end of the production line, to a measurement station 28 through a pipeline 30. Prior to the measurement station the rod is retarded in a decelerator 32. The decelerator comprises a pair of rollers rotating with equal and opposite angular velocities. Filters from the line 30 pass between the rollers and are expelled at a constant speed determined by the rotation speed of the rollers. In the measurement station the RTD is measured in an RTD gauge head 33 and the filter rod then drops into a tape gauge 34 where the diameter is measured. The tape gauge 34 is a standard type and is well known in the art. After the diameter has been measured the rod drops into a scale. After each RTD and diameter measurement the result is transmitted to the system controller 36. At approximately 20 second intervals further rods are introduced into the measurement station. After the system controller has received 5 RTD and diameter measurements, mean and standard deviation values for the two parameters are calculated and displayed on a screen. In addition the individual values of RTD and diameter are displayed as they are received.

If the means values are within prescribed limits then no action is taken and testing continues with the same machine parameters. If the mean values fall outside the prescribed limits remedial action is taken at 38 to adjust the delivery roller speed and/or the upper garniture driving motor speed. The nature of the remedial action taken depends on the severity of the deviations from the prescribed limits and operates according to a predetermined hierarchical system of priorities as will be described in due course. After 10 rods have been tested for RTD and diameter the average weight of the 10 rods is determined at 40 and the result transmitted to and displayed at the controller 36. The 10 rods are then ejected (at 42) and discarded.

Where the measurements approach reject values an alarm signal is generated (at 43) and sent to a display terminal 44 and/or an alarm 46. In the extreme case the system controller may generate a stop signal (at 47) which can halt temporarily the manufacturing process if one or more of the parameters is not responding to control or the deviation from the prescribed value exceeds a predetermined level.

The system controller also derives diagnostic reports of performances over a shift which may be transmitted to a host computer 48 for processing.

The sampling structure can, of course, be changed by the process manager who may also vary the specification of the filter, for example to change to filters for cigarettes of a smalller diameter. The number of rods per mean sample may also be changed.

The system processor compares the mean RTD and Diameter Measurements with stored values. A target value is specified and four bands specified either side of the target value as is shown in table 1 below.

TABLE I

| | |
|---|---|
| 4. REJECTION OF RODS + MACHINE STOP | |
| 3. AUTOMATIC CORRECTION + ALARM | |
| 2. AUTOMATIC CORRECTION | |
| 1. NO ACTION | TARGET |
| 1. NO ACTION | |
| 2. AUTOMATIC CORRECTION | |
| 3. AUTOMATIC CORRECTION + ALARM | |
| 4. REJECTION OF RODS + MACHINE STOP | |

If the mean falls within band 1 then it is considered acceptable and no corrective action is taken. If it falls within band 2 then corrective action is taken as will be described. Corrective action is also taken if the value is in band 3 but an alarm signal is generated in addition. If the mean is in band 4 the condition is considered unacceptable and a machine stop signal is generated.

The individual memory areas 1 to 4 are determined statistically for each filter specification.

Table II shows the system of priorities which is ascribed to the RTD and diameter control.

TABLE II

| | | |
|---|---|---|
| DIAMETER HIGH | (2) RTD HIGH | (2) = CORRECT RTD |
| DIAMETER VERY HIGH | (3) RTD VERY HIGH | (3) = CORRECT RTD |
| DIAMETER LOW | (2) RTD LOW | (2) = CORRECT RTD |
| DIAMETER VERY LOW | (3) RTD VERY LOW | (3) = CORRECT RTD |
| DIAMETER HIGH | (2) RTD LOW | (2) = CORRECT DIAMETER |
| DIAMETER VERY HIGH | (3) RTD VERY LOW | (3) = CORRECT DIAMETER |
| DIAMETER LOW | (2) RTD HIGH | (2) = CORRECT DIAMETER |
| DIAMETER VERY LOW | (3) RTD VERY HIGH | (3) = CORRECT DIAMETER |
| DIAMETER HIGH | (2) RTD OK | (1) = CORRECT DIAMETER |
| DIAMETER VERY HIGH | (3) RTD OK | (1) = CORRECT DIAMETER |
| DIAMETER LOW | (2) RTD OK | (1) = CORRECT DIAMETER |
| DIAMETER VERY LOW | (3) RTD OK | (1) = CORRECT DIAMETER |
| DIAMETER OK | (1) RTD HIGH | (2) = CORRECT RTD |
| DIAMETER OK | (1) RTD VERY HIGH | (2) = CORRECT RTD |
| DIAMETER OK | (1) RTD VERY HIGH | (3) = CORRECT RTD |
| DIAMETER OK | (1) RTD LOW | (2) = CORRECT RTD |
| DIAMETER OK | (1) RTD VERY LOW | (3) = CORRECT RTD |
| DIAMETER VERY HIGH | (3) RTD HIGH | (2) = CORRECT RTD AND DIAMETER |
| DIAMETER VERY HIGH | (3) RTD VERY HIGH | (3) = CORRECT RTD AND DIAMETER |
| DIAMETER HIGH | (2) RTD VERY HIGH | (3) = CORRECT RTD AND DIAMETER |
| DIAMETER VERY HIGH | (3) RTD VERY HIGH | (3) = CORRECT RTD AND DIAMETER |

In table II the numbers in brackets refer to the memory areas of table I.

Rather than correcting to the target value itself, the system processor 36 ensures that corrections are made to bring the diameter and RTD into the allowable ranges; that is the somewhere within area 1 in table I. This method has proved to be more effective than correcting to the target value as it avoid problems of over reaction and takes into account inherent variations in the machines.

It will be appreciated that conditions in which both diameter and RTD require correction can be corrected in two stages. Consider the case where both parameters are high, falling within area 2. After the mean of 5 samples has been calculated the RTD will be corrected. After five further samples the mean RTD should fall within area 1. The system will then check if the diameter requires correction. This will not always be necessary as RTD correction affects the diameter.

No feedback is associated with the weight measurement. However, the weight values are passed to the processor and compared with acceptable values. If the weight value comparison falls within an area corresponding to area 4 of table I an alarm signal is sent at 43 and the production line is stopped.

Figure 3:
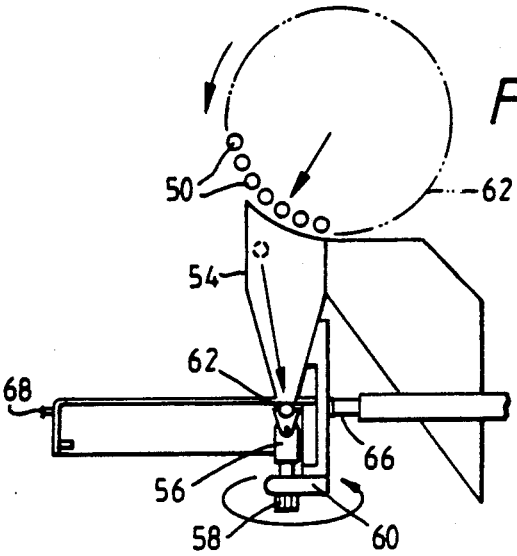
FIGS. 3 and 4 show a filter pick-up device embodying a second aspect of the invention.
Figure 4:
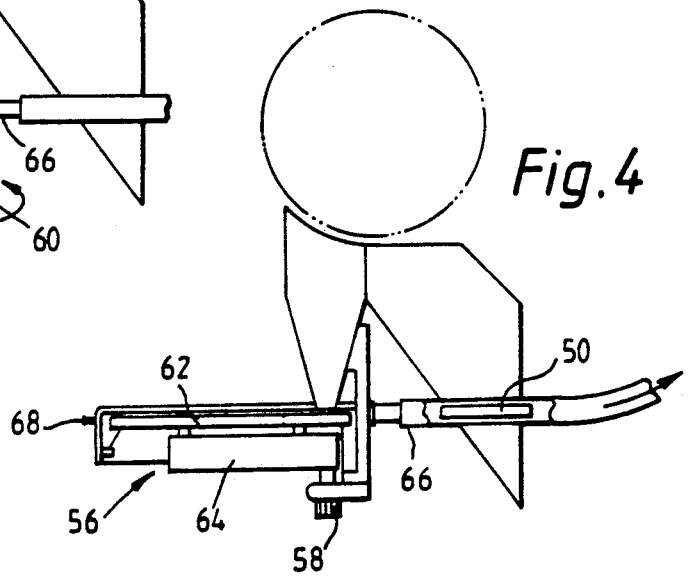

FIGS. 3 and 4 illustrate in more detail the pick up unit 26. Finished filter rods 50 are fed from the cut off head to a pick-up drum 52 which is a fluted drum receiving a filter in each flute. Beneath the drum is arranged a hopper 54 arranged above a pick-up shuttle 56 which is rotatable about a vertical axis 58 by means of a pneumatic actuator 60. A compressed air source is arranged to blow filters from the pick-up shuttle 56 into a pneumatic line and then towards the measurement station 28 (FIG. 2).

The pick-up unit operates as follows: pneumatic actuator 60 rotates the pick-up shuttle 56 through 90° about axis 58 into the position shown in FIG. 3. A filter 50 is ejected from the pick-up drum and passes through hopper 54, the tapered end of which guides the filter into a channel 62 in the pick-up shuttle 56. The bracket 64 of the pick-up shuttle is then pneumatically rotated back to its starting position in which the channel of the shuttle is aligned with pneumatic line 66 (FIG. 4). Compressed air from source 68 then expels the filter from the shuttle and propels it along the line 66 to the measuring station.

Filters then continue to be ejected normally into a storage container (not shown).

The pick-up unit has the advantage of being simple, having few working parts. If a filter jams the pick-up may be reset automatically. Furthermore the unit is very compact as the pneumatic line 66 through which filters are ejected is orthogonal to the pick-up drum.

Figure 5:
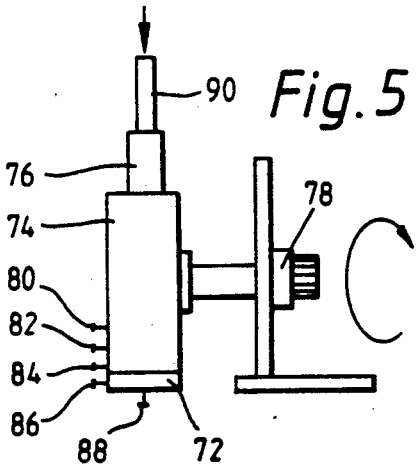
FIGS. 5 and 6 show, schematically, an RTD gauging head embodying a further aspect of the invention.
Figure 6:
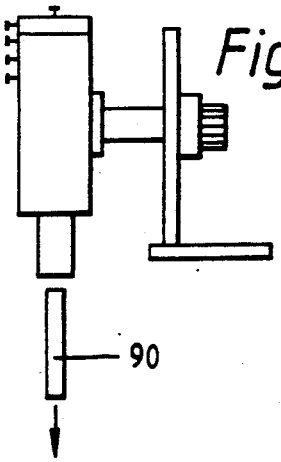
Figure 7:
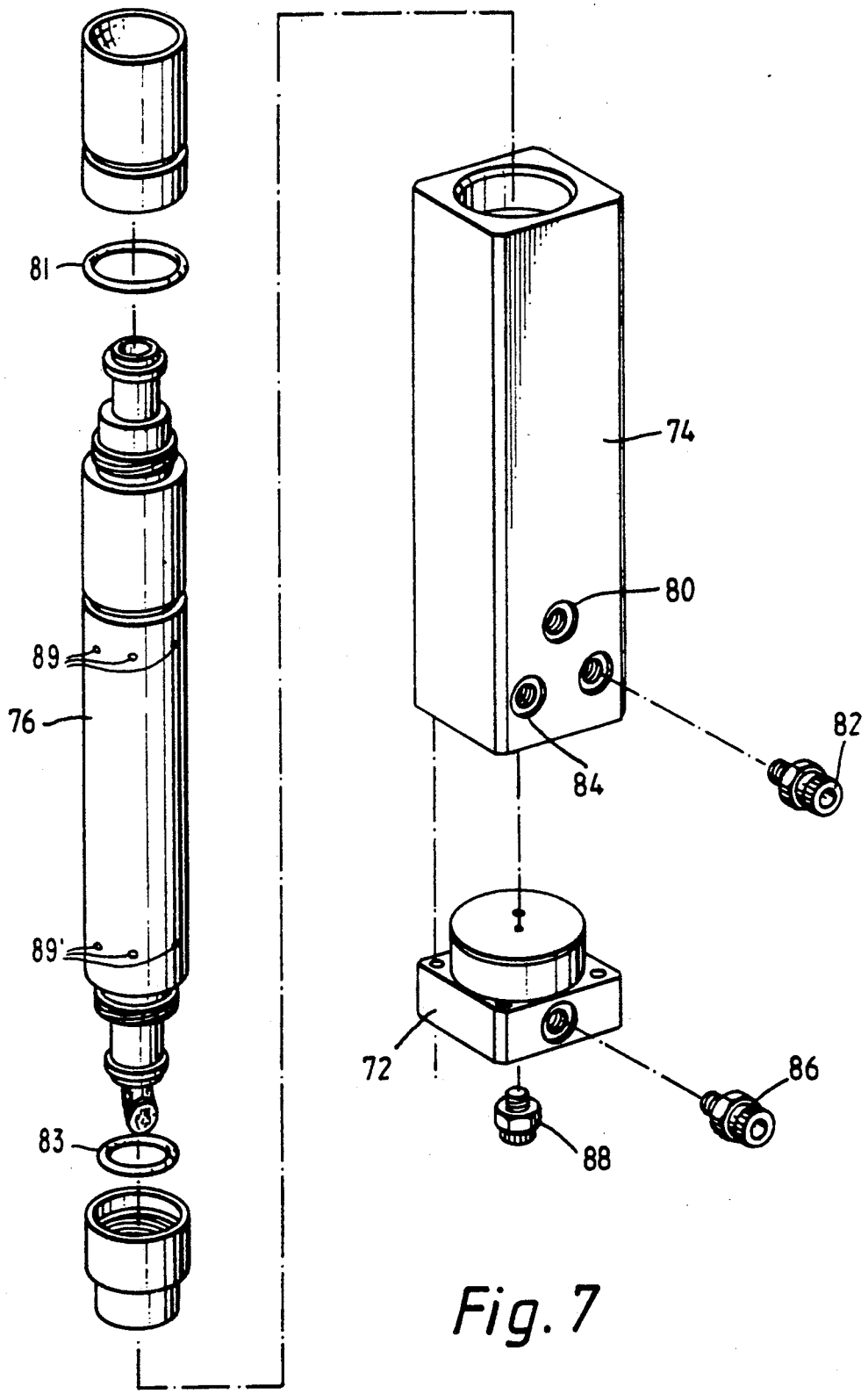
FIG. 7 is an exploded view of the gauging head of FIGS. 5 and 6.

FIGS. 5 and 6 show the resistance to draw RTD gauge 33 (FIG. 2) in greater detail, FIG. 7 is an exploded view. The gauge comprises a base 72, a gauging head 74 and a sleeve 76. The gauge is connected to an actuator 78 which can rotate the head through 180° between the positions shown in FIGS. 5 and 6. In addition the gauge head is provided with a vacuum inlet 80, an air flow inlet 82, which communicates with sleeve 76 through corresponding ports 89, and an air flow outlet 84, which communicates with sleeve 76 through corresponding ports 89'. The base 72 is provided with a rejection air flow inlet 86 and a further inlet 88 for an air jet to position the filter within the gauge.

Before a filter 90 is expelled from the decelerator 30 (FIG. 2) a vacuum is created through port 80 between seals 81, 83 (FIG. 7), the sleeve 76 and the gauging head 74. When a filter is dropped into the gauging head a jet of air is passed through port 88 to position the filter correctly in the head. The vacuum is then released. When the filter is within the sleeve 76, air is blown through port 82 at a constant speed (17.S ml/sec,. The pressure drop is measured through port 84 by means of a transducer (not shown); an RTD value is calculated from this pressure drop and transmitted to the system processor. The gauging head is then rotated to the position shown in FIG. 6 and the head is unsealed by operating the vacuum through port 80. Air is then blown in through port 86 to eject the filter 90 towards the tape gauge where the diameter of the filter is measured.

We claim:

1. A method of controlling the manufacture of cigarette filters, comprising:

periodically removing a completed filter from a production line on which said filters are manufactured;

measuring at least two variable parameters of said remove filter;

comparing each of said measured parameters with a respective predetermined target;

in response to said comparison, if one or both of said parameters are outside their respective targets, selecting for adjustment one of said parameters in accordance with a predetermined set of priorities dependent upon which parameter is outside said target and the degree and sense of each excursion from said target; and adjusting the operating conditions affecting the selected parameter.

2. The method of claim 1, wherein said target for each parameter comprises a range of acceptable values around a target value and said adjustment of the operating conditions causes one of the parameters to move into the acceptable range.

3. The method of claim 2, wherein said adjustment made aims to correct the parameter to bring it to the limit of the acceptable range.

4. The method of claim 1, further comprising measuring said parameters for a plurality of filters and making said adjustments in accordance with the mean values of said parameters.

5. The method of claim 1, wherein said excursions from the target are divided into at least two bands for each of said parameters, one of said parameters being corrected for if both said measured parameters fall outside their targets within a first of said excursion bands, both of said parameters being corrected for if one of said parameters falls within a second of said excursion bands more distant from the target than said first band and said other parameter falls within said first excursion band.

6. The method of claim 1, wherein said measured parameters are the diameter and the resistance to draw (RTD) of said cigarette filter.

7. The method of claim 5 wherein:

said measured parameters are the diameter and the resistance to draw (RTD) of said cigarette filter; and said filter diameter and RTD are corrected either at the same time or in accordance with a preset hierarchy of priorities.

8. The method of claims 5, comprising generating an alarm signal if either parameter is in said second excursion band.

9. The method of claim 5 wherein a third excursion band is defined, said third excursion band being more distant from said target than said second excursion band and said production line is stopped if a parameter falls within said third excursion band.

10. Apparatus for controlling the manufacture of cigarette filters, comprising:

means for periodically removing for testing a filter from the production line on which said filters are manufactured;

means for measuring at least two variable parameters of said filter;

means for comparing each of said measured parameters with respective predetermined targets;

means responsive to said comparison, if either comparison is not acceptable, for selecting for adjustment one of said parameters in accordance with a predetermined set of priorities dependent upon which parameter is outside said target and the degree and sense of each excursion from said target; and means for adjusting the selected parameter.

11. The apparatus of claim 10, wherein said adjustment means comprises means for adjusting each parameter to a value just within a range of values around the target value.

12. The apparatus of claim 10, wherein completed filter are held in a drum on said production line and the filter removal means comprises means for ejecting a filter from said drum; a shuttle for holding filters, means for guiding an ejected filter into said shuttle; a delivery tube for receiving filters from the shuttle; and means for rotating said shuttle between a first position in which it can receiver filters from said filter drum, and a second position in which a received filter can be ejected by compressed gas to said delivery tube, the filters in the second position being othogonal to the filters on the drum.

13. The apparatus of claim 10, wherein said measuring means comprises means for measuring the resistance to draw of a cigarette filter, the means comprising a gauge including a gauge head having air inlet and outlet ports; means arranged within the gauging head for receiving a filter to be tested, the filter receiving means having corresponding ports allowing passage of air from the gauging head ports across a filter inserted in the receiving means; the gauge further including a base portion having a portion communicating with the receiving means for the passage of gas into the receiving means to assist the ejection of filters from the receiving means; said measuring means further comprising means for inverting the gauge for ejection of a filter.

14. The apparatus of claim 13, further comprising means for measuring the pressure drop at the exit port to determined the resistance to draw of a filter.

* * * * *